United States Patent [19]

Williams

[11] 3,954,205

[45] May 4, 1976

[54] TOOTHPASTE DISPENSER

[76] Inventor: Shelly R. Williams, P.O. Box 343, Goodlettsville, Tenn. 37072

[22] Filed: Feb. 28, 1975

[21] Appl. No.: 554,391

[52] U.S. Cl. ..... 222/100
[51] Int. Cl.[2] ..... B65D 35/34
[58] Field of Search ..... 222/99, 100

[56] References Cited

UNITED STATES PATENTS 2,883,087 4/1959 Nichols, Jr. ..... 222/100

FOREIGN PATENTS OR APPLICATIONS 986,370 3/1965 United Kingdom ..... 222/100

*Primary Examiner*—Allen N. Knowles
*Assistant Examiner*—Norman L. Stack, Jr.
*Attorney, Agent, or Firm*—Clarence A. O'Brien; Harvey B. Jacobson

[57] ABSTRACT

A panel member constructed of stiff but bendable material is provided and includes a pair of opposite side marginal portions bent at generally right angles relative to and outwardly of the same side of the panel or panel member. The opposite side marginal portions are provided with aligned bores defining journals and a winding shaft is journaled through the bores and provided with anchor means between the opposite side marginal portions of the panel member for anchoring the closed end of a collapsible tube to the shaft for winding thereon. The bores are defined by the greater width ends of keyhole slots formed in the panel and whose lesser width ends extend across the folded zones defining the right angle bent opposite marginal portions of the panel and into those portions of the panel extending between the opposite side marginal portions. A slit is formed in the panel with its opposite ends opening into the adjacent ends of the lesser width ends of the keyhole slots and the edge portions of the panel defining the opposite sides of the slit are deflected, at least slightly, toward the shaft and thereby define a narrow slot therebetween with the sides of the slit defining edge portions remote from the shaft smoothly convexly curving into the slot whereby to define an entrance throat for the slot, a collapsible tube being wound on the shaft being gradually squeezed into a flattened condition as it is drawn through the slot.

7 Claims, 5 Drawing Figures

TOOTHPASTE DISPENSER

BACKGROUND OF THE INVENTION

Various forms of toothpaste dispensers have been heretofore provided and many of these dispensers include at least some of the general structural and operational features of the instant invention. Examples of some of these previously known devices are disclosed in U.S. Pat. Nos. 648,981; 1,566,193; 1,669,247; 1,826,189; 2,896,822 and Swiss Patent No. 218,785, dated Apr. 16, 1942. In addition, a quite similar toothpaste dispenser of which the toothpaste dispenser of the instant invention comprises an improvement is disclosed in my prior U.S. Pat. No. 3,173,578, dated Mar. 16, 1965.

BRIEF DESCRIPTION OF THE INVENTION

The toothpaste dispenser of the instant invention, except for the toothpaste tube winding shaft portion thereof, is constructed from a single planar panel of stiff but bendable material suitably apertured in predetermined locations and bent along three fold lines.

The basic structure of the dispenser of the instant invention is dislosed in my prior U.S. patent above noted, but the extreme simplicity of the dispenser of the instant invention as well as the ability to construct the dispenser, except for the shaft portion thereof, by simple stamping and right angle bending steps results in an apparatus which may be far more economically produced and thus manufactured at a lower cost to the consumer. In addition, the dispenser of the instant invention includes structure whereby the entire width of an associated collapsible toothpaste tube will be evenly squeezed.

The main object of this invention is to provide a toothpaste dispenser which will be operative to evenly squeeze substantially all of the toothpaste from a collapsible toothpaste tube or the like.

Another object of this invention, in accordance with the immediately preceding object, is to provide a paste dispenser including means thereon for also supporting toothbrushes when not in use.

A final object of this invention to be specifically enumerated herein is to provide a toothpaste dispenser in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 5:
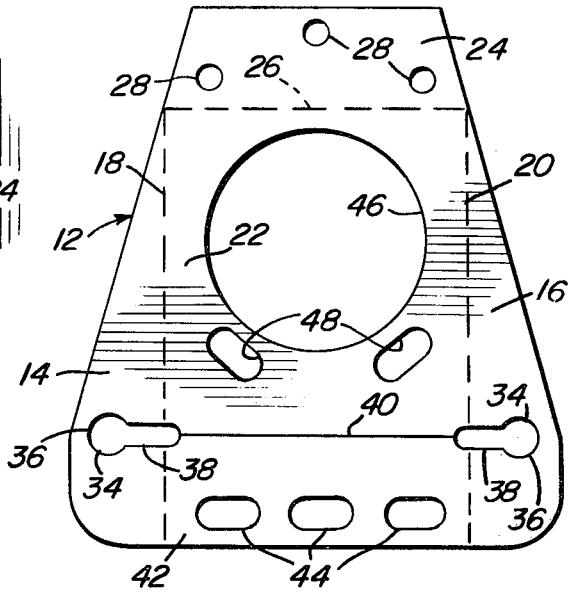
FIG. 5 is a plan view of a blank of stiff but bendable material from which the entire dispenser of the instant invention may be formed, except for the shaft portion, by accomplishing four bending steps.
Figure 2:
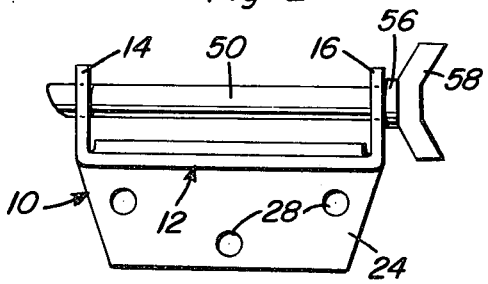
FIG. 2 is a front elevational view of the dispenser.
Figure 3:
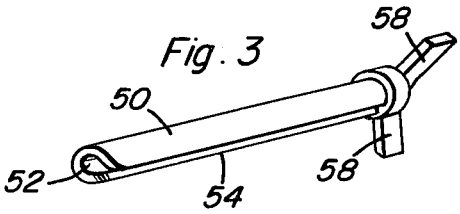
FIG. 3 is a perspective view of the tube winding shaft portion of the dispenser.

Referring now more specifically to the drawings, the numeral 10 generally designates the dispenser of the instant invention. From FIG. 5 of the drawings it may be seen that the dispenser 10 may be constructed from a planar panel-like body 12 constructed of stiff but bendable material. The body 12 includes opposite side marginal edge portions 14 and 16 defining an intermediate portion of the body therebetween, which are bent along bend zones 18 and 20 in order that the opposite side marginal edge portions 14 and 16 will project upwardly from the upper surface 22 of the panel. The bend zones 18 and 20 parallel each other and accordingly, the opposite side marginal portions 14 and 16, after being bent, define parallel flanges.

The panel 12 further includes a rear marginal edge portion 24 which is bent along a bend zone or line 26 in a downward direction so as to define a depending mounting flange. The marginal edge portion 24 is provided with a plurality of mounting apertures 28 through which suitable fasteners 30 may be secured in order to mount the dispenser 10 on a wall surface 32.

The forward end portions of the opposite side marginal portions 14 and 16 are provided with keyhole openings or slots 34 including greater width ends 36 and lesser width ends 38 which extend toward each other and cross the fold zones 18 and 20. In addition, the panel 12 is provided with a slit 40 extending between and having its opposite ends opening into the adjacent portions of the narrow width ends 38 of the keyhole openings 34 and the central portion of the forward marginal edge portion 42 of the panel 12 is provided with three oblong openings 44. Still further, the central portion of the panel 12 spaced between the fold zones 18 and 20 and the fold zone 26 and slit 40 is provided with a large diameter opening 46 and a further pair of oblong openings 48 spaced between adjacent portions of the opening 46 and the keyhole openings 34. Of course, the openings 28, 34, 44, 46 and 48 are formed in the panel 12 as the panel 12 is cut or stamped from a larger panel. Thereafter, the marginal portions 14 and 16 are bent along bend zones 18 and 20 and the marginal portion 24 is bent along the fold zone 26.

The dispenser 10 further includes an elongated shaft 50 having a central longitudinal bore 52 formed therein and opening outwardly of one end of the shaft 50. The shaft 50 is also provided with a longitudinal radial slot 54 of lesser width than the diameter of the bore 52 and which also opens through the end of the shaft 50 through which the bore 52 opens, the slot 54 opening into the bore 52.

The end of the shaft 50 remote from the open end of the bore 52 is provided with a diametrically enlarged head 56 including finger-engageable wings 58 whereby rotational torque may be readily applied to the shaft 50.

After the panel 12 has been stamped out and bent in the manner heretofore set forth, those marginal portions of the panel 12 defining the opposite side portions of the slit 40 are bent upwardly and thereby slightly spread apart to define a slot 60. In addition, as may be seen from FIG. 4, the side surfaces 62 of the marginal portions of the panel 12 disposed on opposite sides of the slot 60 are smoothly convexly curved so as to define an entrance throat opening into the slot 60.

Figure 1:
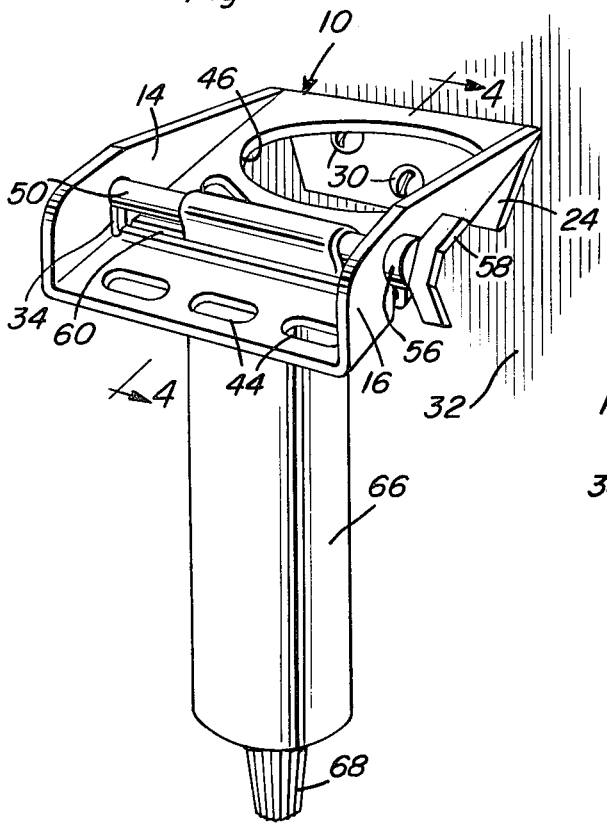
FIG. 1 is a perspective view of the dispenser of the instant invention with a tube of toothpaste operatively associated therewith.

When it is desired to use the dispenser 10, the shaft 50 is axially withdrawn to the right as viewed in FIG. 1 of the drawings until the end of the shaft 50 remote from the enlargement 56 is closely spaced inwardly of the marginal edge portion or flange 16. Then, the closed beaded end 64 of a collapsible tube 66 is inserted upwardly through the slot 60 to a position in registry with the bores defined by the wider ends of the keyhole openings 34. Then, with the slot 54 in the shaft 50 opening downwardly toward the slot 60, the shaft 50 is axially displaced to the left in a manner such that the beaded closed end 64 is received in the bore 52 and the slot 54. The shaft 50 is further displaced to the left until the end thereof remote from the enlargement 56 is received through the greater width end 36 of the keyhole opening 34 formed in the marginal portion of flange 14. Thereafter, the shaft 50 is rotated in order to wind a small portion of the tube 66 thereon.

From this point on, when it is desired to dispense paste from the tube 66, the cap 68 is removed and the shaft 50 is rotated until the desired amount of paste has been expressed from the tube 66. Thereafter, the cap 68 is replaced. Of course, the shaft 50 is reversably received through the greater width ends 38 of the keyhole openings or slots 34 and the dispenser may thus be adapted for both right- and left-handed persons. Also, the opening 46 is designed to receive a tumbler, glass or cup and the openings 44 and 48 may be used to support toothbrushes.

Figure 4:
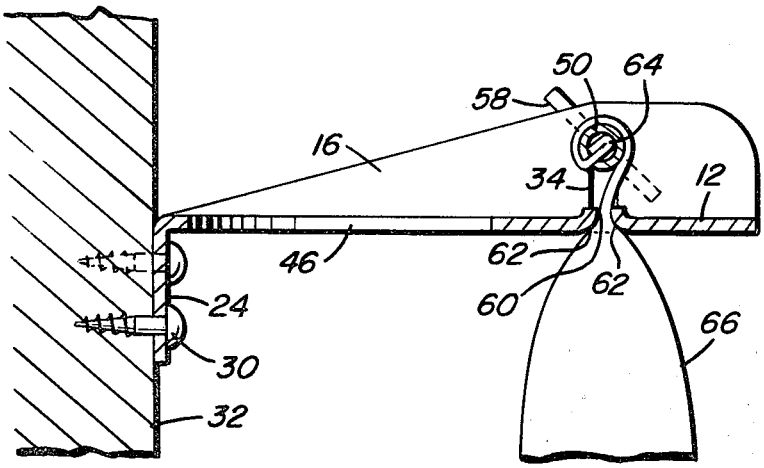
FIG. 4 is an enlarged fragmentary vertical sectional view taken substantially upon the plane indicated by the section line 4—4 of FIG. 1.

It will be noted from FIG. 4 of the drawings that the cylindrically radiused surfaces 62 serve to gradually squeeze the tube 66 into a substantially fully flattened condition as the tube 66 is pulled through the slot 60 by the winding of the closed end of the tube 66 on the shaft 50.

Inasmuch as the opposite ends of the slit 40 open into the adjacent portions of the narrow width ends 38 of the keyhole openings 34, the marginal portions of the panel 12 disposed on opposite sides of the slit 40 may be smoothly and equally upwardly deflected or curved throughout their entire length. Accordingly, the width of the slot 60 is constant throughout its longitudinal extent.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A toothpaste dispenser comprising a generally horizontal panel constructed of stiff but bendable material and including opposite side marginal portions bent upwardly at generally right angles relative to said panel and along generally parallel bend zones, a pair of aligned bores formed in said opposite side marginal portions spaced above the intermediate portion of said panel extending between said opposite side marginal portions, a winding shaft journaled in and extending between said bores, said shaft including anchor means for anchoring the closed end of a collapsible tube to said shaft for winding of said tube thereon, said intermediate panel portion having a slit formed therethrough extending generally along a diametric plane of said shaft disposed generally normal to said intermediate panel portion, the edge portions of the intermediate panel portion defining the opposite sides of said slit being upwardly deflected, at least slightly, toward said shaft and thereby defining a narrow slot therebetween with the sides of the slit defining edge portions of said intermediate panel portion remote from said shaft smoothly convexly curving into said slot whereby to define an entrance throat therebetween, said bores being defined by the greater width ends of keyhole slots formed in said panel whose lesser width ends extend across said fold zones and into said intermediate panel portion toward each other, the opposite ends of said slit opening into the adjacent ends of the lesser width ends of said keyhole slots.

2. The combination of claim 1 wherein said anchor means includes a longitudinally extending slot formed in said shaft opening outwardly through at least one side of said shaft and adapted to receive the closed headed end of a collapsible tube therein.

3. The combination of claim 2 wherein said shaft includes a longitudinal bore formed therein opening outwardly through at least one end of said shaft and of a diameter greater than the width of said slot.

4. The combination of claim 1 wherein said slit extends along a path disposed at substantially right angles relative to said bend zones.

5. The combination of claim 1 wherein said panel includes a third marginal edge portion extending between one pair of corresponding ends of said opposite side marginal portions and bent at generally right angles relative to said panel, said third marginal edge portion having mounting fastener openings formed therethrough.

6. The combination of claim 1 wherein the central portion of said panel portion includes a large diameter opening formed therethrough spaced to one side of said slit adapted to partially downwardly receive the lower end portion of a downwardly tapering tumbler therethrough.

7. The combination of claim 1 wherein said shaft is axially reversably removably bores by said journals and one end of said shaft includes means adapted to enable torque to be manually applied to said one end of said shaft.

* * * * *